United States Patent [19]

Wieland

[11] Patent Number: 4,821,643

[45] Date of Patent: Apr. 18, 1989

[54] SWITCHABLE SHEET FED ROTARY PRINTING PRESS

[75] Inventor: Erich G. Wieland, Würzburg, Fed. Rep. of Germany

[73] Assignee: Koenig & Bauer Aktiengesellschaft, Würzburg, Fed. Rep. of Germany

[21] Appl. No.: 255,348

[22] Filed: Oct. 11, 1988

[30] Foreign Application Priority Data

Oct. 12, 1987 [DE] Fed. Rep. of Germany ..... 3734493
Nov. 13, 1987 [DE] Fed. Rep. of Germany ..... 3738674

[51] Int. Cl.[4] ..... B41F 21/04; B41F 21/10
[52] U.S. Cl. ..... 101/230; 101/183
[58] Field of Search ..... 101/142, 137, 154, 177, 101/183, 217, 218, 246, 247, 408, 411, 229–232; 271/306, 108

[56] References Cited

U.S. PATENT DOCUMENTS

| | | | |
|---|---|---|---|
| 3,537,391 | 11/1970 | Mowry et al. | 101/230 |
| 3,654,861 | 4/1972 | Rudolph et al. | 101/183 |
| 4,015,522 | 4/1977 | Preuss et al. | 101/230 |
| 4,202,266 | 5/1980 | Zahradwik | 101/218 |
| 4,362,099 | 12/1982 | Iwamoto | 101/230 |
| 4,409,894 | 10/1983 | Fischer | 101/230 X |
| 4,535,691 | 8/1985 | Kida | 101/230 |
| 4,621,576 | 11/1986 | Wirz | 101/217 |
| 4,664,032 | 4/1987 | Abenroth et al. | 101/230 |
| 4,716,827 | 1/1988 | Wieland et al. | 101/216 |
| 4,723,489 | 2/1988 | Emrich et al. | 101/230 |

*Primary Examiner*—Eugene M. Eickholt
*Attorney, Agent, or Firm*—Jones, Tullar & Cooper

[57] ABSTRACT

A sheet fed rotary printing press is switchable between recto and recto and verso printing. A sheet transfer drum carries sheet leading and trailing edge grippers which are shiftable with respect to each other by use of a disengagable clutch. When the sheet transfer drum is placed in the recto position, stops that are carried in the leading and trailing edge grippers abut each other.

1 Claim, 2 Drawing Sheets

SWITCHABLE SHEET FED ROTARY PRINTING PRESS

FIELD OF THE INVENTION

The present invention is directed generally to a sheet fed rotary printing press. More particularly, the present invention is directed to a sheet fed rotary printing machine which is switchable between recto printing and recto and verso printing. Most specifically, the present invention is directed to a sheet fed rotary printing press switchable between recto and recto and verso printing and having a sheet transfer drum disposed between two printers. The sheet transfer drum has a drum body which is supported in the machine frame by hollow journals and which has sheet grippers to grip the front edge of the sheets being transferred. Sheet holding or gripping means are also provided to grasp the rear portions of sheets carried on the sheet transfer drum. These sheet holding or gripping means are carried by a hollow shaft that is supported in the hollow journals. Gear wheels that have identical diameters are wedged on one of the hollow journals of the sheet transfer drum, and an end of the shaft which carries the sheet holding means. One of the gear wheels engage a gear carried by a transfer cylinder while the second engages a gear of a reversing drum that is situated downstream, in the direction of sheet travel, and which has a gripper system for gripping either the front or trailing edge of a sheet on the sheet transfer drum, depending on whether the printing press is operating in recto or recto and verso printing. A disengagable clutch connects the two gear wheels carried by the sheet transfer drum so that the angular orientation of the leading edge sheet grippers and the trailing edge sheet holding means on the sheet transfer drum may be adjusted with respect to each other.

DESCRIPTION OF THE PRIOR ART

A sheet fed rotary printing press that has a sheet transfer drum is generally shown in U.S. Pat. No. 4,716,827, which is assigned to the assignee of the present application. This patent discloses an assembly in which the clutch between the two gear wheels is a shrink connection which can be temporarily disconnected by means of a so-called oil pressure connection for the purpose of changing the angular position of the gear wheel by charging with oil under pressure. In these generally known sheet-fed rotary printing presses, the two devices for gripping the front and rear edges of the sheets can be adjusted in a simple manner during a change from recto printing to recto and verso printing and vice versa. Although the adjustments can be made by only disconnecting the clutch between the two gear wheels, the adjustment of the prior art sheet-fed rotary printing press still presents difficulties, because the respective correct angle positions of the sheet grippers and sheet holding means for recto printing and for different sheet lengths during recto and verso printing must be determined.

SUMMARY OF THE INVENTION

It is an object of the present invention to provide a switchable sheet fed rotary printing press.

Another object of the present invention is to provide a switchable sheet fed rotary printing press having a sheet transfer drum with adjustable sheet grippers and sheet holders.

A further object of the present invention is to provide a switchable sheet transfer drum which is adjustable to different format lengths of sheets.

Still another object of the present invention is to provide a switchable sheet transfer drum having fixed stops.

As will be discussed in greater detail in the description of the preferred embodiment which is set forth subsequently, the sheet fed rotary printing press in accordance with the present invention has a sheet transfer drum in which in the recto printing position, the arc distance between the devices for gripping the front and rear edges of the sheets on the sheet transfer drum corresponds to an arc distance on the reversing drum which is composed of the distance of the grippers on the reversing drum for gripping the front and rear edges of the sheets, and of a distance resulting from the displacement of the rear edge of the sheet during reversing, plus the required paper edge for gripping the respective sheet at its front or rear edge. Furthermore, the recto printing position can be set on the sheet transfer drum by means of cooperating stops on the devices for gripping the front and rear edges of the sheets on the sheet transfer drum or on the gear wheels which can be coupled with each other.

The recto printing position can be readjusted in a simple manner without complicated setting and measuring steps by disengaging the clutch and sliding together the stops and then re-connecting the gear wheels with each other. Because the recto printing position is determined by the stops, it is always easy to find it again after the devices for gripping the front and rear ends of the sheets on the sheet transfer drum have been moved.

If a change from recto to recto and verso printing is to be made, this is accomplished easily because only the gripper system of the reversing drum needs to be activated in such a way that its reversing grippers will grip the rear edges of the sheets. In the sheet fed rotary printing press in accordance with the present invention, the position of the gripping devices on the sheet transfer drum for the front and rear edges of the sheets during the change from recto to recto and verso printing corresponds to the greatest format length of the sheets to be printed. If the sheets are to be printed with shorter format lengths, the clutch connecting the gear wheels must be disengaged and the gripper devices on the sheet transfer drum for gripping the front and rear edges of the sheets must be adjusted to the new format by accomplishing a relative turning of the parts of the sheet transfer drum on which the sheets rest. Because the cooperating parts of the sheet transfer drum are in engagement, through their gear wheels, with the gear trains leading to the printers which are placed ahead and behind of the sheet transfer drum, a phase-correct adjustment of these printers automatically takes place when the format is changed, so that the register does not need to be reset. If, during the recto and verso printing operations, the format of the paper to be printed is to be changed, it is only necessary to disengage the clutch and to turn the gear wheels in relation to each other in such a way that the arc distance between the devices for gripping the front edges of the sheets and rear edges of the sheets corresponds to the new paper format. Because the respective gear wheels carried by the sheet transfer drum body and the shaft supported in it, which shaft is the support for the device for gripping the rear edges of the sheets, are in engagement with the gear wheel of the transfer cylinder on the one hand and with the gear wheel of the reversing drum on the other, they are always coupled in phase-correct manner with the two printers. Thus, in each position of the angle of the rotation of the two gripping components of the sheet transfer drum, the phase position of the devices for gripping the front edges of the sheets and for gripping the rear edges of the sheets corresponds with the printers placed ahead and behind, so that no additional and complicated adjustment steps need to be taken to reach the correct phase position of the gripper devices with respect to the associated printers or to the gear trains leading to them. Therefore, in the sheet fed rotary printing press in accordance with the present invention, the position of the angle of rotation of the two sheet transfer drum parts carrying the devices for gripping the front and rear edges of the sheets is such that in each phase position of the printers the gripper device of the feeding drum or transfer cylinder cooperates with the gripper device of the sheet transfer drum, and the gripper system of the subsequent reversing drum for gripping the rear edge of the sheet cooperates with the format-adjustable holding means of the sheet transfer drum which, for example, consist of a number of suction devices, so that no additional adjustment steps need to be taken and no points of collision occur. The recto printing position can be easily set by sliding together the stops, so that the letter can be reset repeatedly, quickly, and with great accuracy after a recto and verso operation. The number of gear trains in a sheet-fed rotary printing press in accordance with the present invention has not been increased, so that no additional play, which might have an adverse effect on the printing accuracy, needs to be tolerated.

The invention also takes into consideration that, on account of the reversing gripper of the gripping system of the reversing drum, the rear edge of each sheet is displaced at each reversal, the displacement being larger than 0 and smaller than the circumference of the drum less the largest printable paper size.

BRIEF DESCRIPTION OF THE DRAWINGS

While the novel features of the switchable sheet fed rotary printing press in accordance with the present invention are set forth with particularity in the appended claims, a full and complete understanding of the invention may be had by referring to the detailed description of the preferred embodiment which is presented subsequently, and as illustrated in the accompanying drawings in which:

DESCRIPTION OF THE PREFERRED EMBODIMENT

Figure 1:
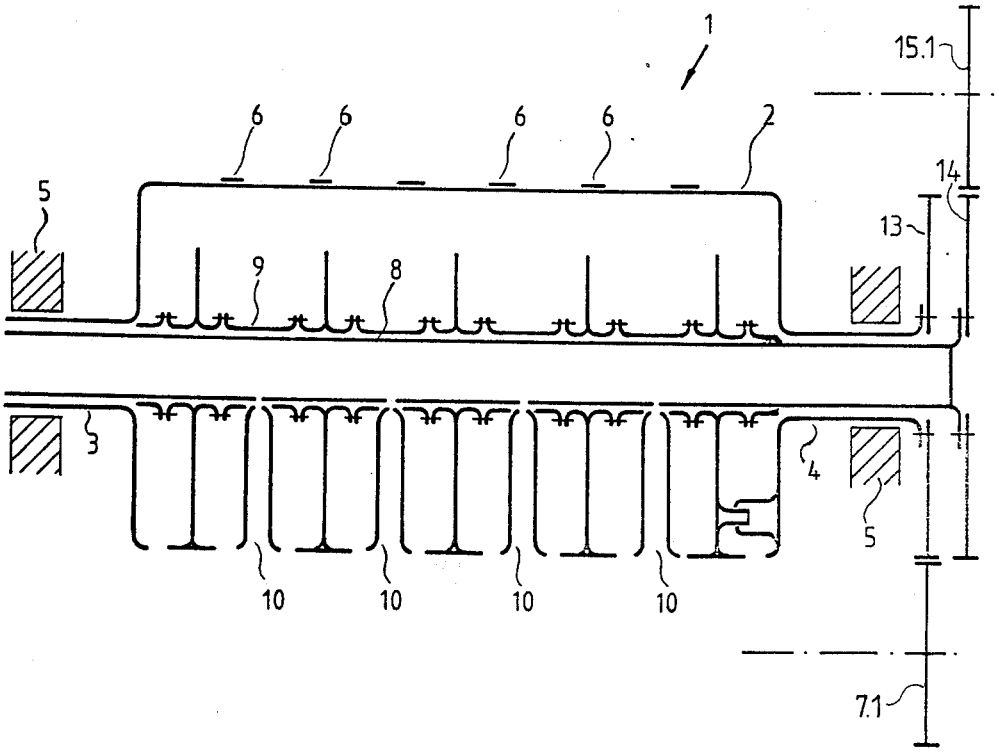
FIG. 1 is a schematic cross-sectional view of a sheet transfer or sheet storage drum of a sheet fed rotary printing press that is switchable between recto and recto and verso printing in accordance with the present invention.
Figure 2:
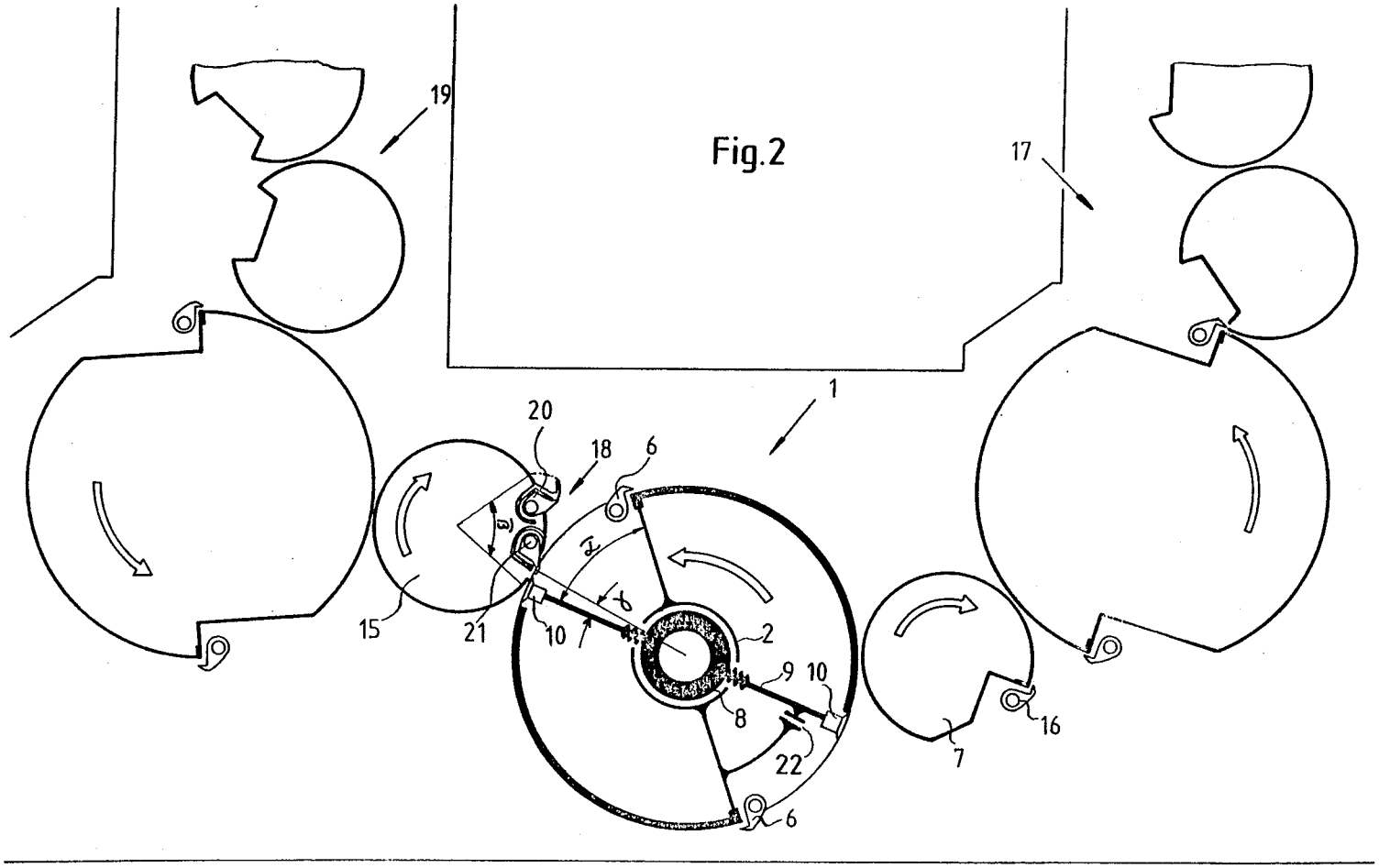
FIG. 2 is a schematic side elevation view of the sheet fed rotary printing press and showing the sheet transfer drum, transfer cylinder and reversing drum of the present invention.

Turning initially to FIG. 2, there may be seen a switchable sheet fed rotary printing press in accordance with the present invention. There is provided a sheet transfer or storage drum, generally at 1 which is shown in greater detail in FIG. 1. Sheet transfer or storage drum, generally at 1 is comprised of a hollow drum body 2 which is rotatably supported in machine frame 5 by hollow journals 3 and 4 that are attached to the ends of the drum body 2. The sheet transfer drum 1 is provided, at its periphery, with a plurality of generally conventional and well known sheet grippers 6 that are used to grip the leading edges of printed sheets which are supplied to the sheet transfer drum 1 from a transfer cylinder 7 that operates in cooperation with a first printing unit 17, as seen in FIG. 2.

A shaft 8 is supported freely rotatable in the hollow journals 3 and 4 of the basic drum body 2. Holding means 9 are fixed on this shaft 8 sectionally or in the shape of segments and are equipped along a convex surface line of the sheet transfer drum 1 with sheet gripping means in the form of suction nozzles 10 for gripping the rear end portions of the sheets. Suction air is supplied to these suction nozzles 10 in a generally conventional manner through the shaft 8, in the form of a hollow passage in the shaft 8, by means of rotating feed-through for the suction air.

A pair of generally parallel and identical sized gear wheels 13 and 14 are positioned generally at one end of sheet transfer drum 1. These two gears 13 and 14 have identical numbers of teeth and pitch. The gear 13 is fixedly secured to journal 4 of drum 1 while the gear 14 is fixedly secured to the end of hollow shaft 8. The gear 13 meshes with a gear 7.1 that is carried by the transfer cylinder 7 while the gear 14 meshes with a gear 15.1 that is carried by the reversing drum 15. These gear pairs 13 and 7.1 or 14 and 15.1 are not separable so that a rotation of gear 13, for example effects a rotation of gear 7.1.

The gears 13 and 14 are connected to each other by means of a disengagable clutch assembly, such as the one disclosed in U.S. Pat. No. 4,716,827. This type of disengagable coupling is generally known in the art and thus is not shown in the drawings. Disengagement of this clutch allows shifting of the gears 13 and 14 with respect to each other.

Referring again to FIG. 2, the selective positions of the transfer cylinder 7 and of the reversing drum 15 with respect to the sheet transfer or storage drum 1 may be seen. The transfer cylinder 7 has a set of sheet grippers 16 and receives sheets from the first printing press 17. These sheets are then taken over by the sheet transfer drum 1 whose grippers 6 grasp the leading edges of the sheets from the grippers 16 of the transfer cylinder 7.

The reversing drum 15 is supplied with a sheet gripper system, generally at 18, and supplies sheets to the second printer 19. As may be seen, this sheet gripper system 18 includes sheet grippers 20 and 21. These two sheet grippers 20 and 21 are used alternatively, depending on the mode of operation of the printing press. Thus if the press is performing recto printing, the grippers 20 of the reversing drum 15 grasp the leading edges of the sheets from the grippers 6 of the sheet transfer drum 1. However, if the press is operating in recto and verso printing, the grippers 21 of the reversing drum 15 will grasp the trailing edges of sheets from the gripper means 10 of the sheet transfer drum. This will effect a turning over of the sheets.

As may be seen in FIG. 2, there are provided stops 22 on the sheet transfer drum 1. These stops are depicted as being between the suction nozzle 10 and the peripheral leading edge sheet grippers 6. However, these stops 22 could also be provided between the gears 13 and 14. These stops 22 contact each other when the sheet transfer drum 1 is set for recto printing. These stops thus secure the recto printing position in which the grippers 20 of the gripper system 18 of the reversing drum 15 cooperate with the grippers 6 of the sheet transfer drum 1. If the press is to be reset from a recto and verso printing operation to a recto printing operation, it is only necessary to slide the stops 22 together. In the position where the stops 22 meet, a tolerance of 0.05 mm in reference to the radian measure of the surface of the jacket of the drum should be adhered to.

In the recto printing position corresponding to the base position, the distance of the arc $\alpha$, the arc of the sheet transfer drum, corresponds to the arc $\beta$, the arc of the reversing drum 15, the length of the arc distance $\beta$ being the result of the length of displacement of the rear edge of the sheet during reversal plus the required page edge for gripping the sheet at the front and rear edges. As may be seen by referring to FIG. 2, the arc distance $\alpha$ is the distance between a set of sheet leading edge grippers 6 and a set of sheet trailing edge gripping means 10. Similarly, the arc distance $\beta$ is the distance between the leading edge sheet grippers 20 and the trailing sheet grippers 21 in the gripper set 18 of the reversing drum 18.

In operation of the switchable sheet fed rotary printing press of the present invention when it is desired to switch from recto to recto and verso printing, the gripper system 20 and 21 of reversing drum 15 is rotated counter-clockwise until the grippers 21 reach the transfer point to sheet transfer drum 1. Due to the fact that the gear 15.1 of reversing drum 15 meshes with gear 14 and the gear 13 to which 14 is engaged, the gripper system 6 and 10 of the sheet transfer drum is rotated in the same way. In this position, the suction nozzles 10 now correspond with the grippers 21. This means that the suction nozzles 10 are situated clockwise, by the dimension of the sheet edge required to grip the sheet edge, in front of the sheet transfer point. In this position, the sheet reversing device 1 and 15 is adjusted to the highest paper size to be used.

If the reversing device 1 and 15 is to be adjusted to a different paper size, the gears 13 and 14 will be disengaged. Thereafter, the gear 15.1 of reversing drum 15 is rotated until the corresponding suction nozzles 10 are adjusted to the new paper size. In this position the gear 13 and the gear 14 will be engaged again. The new arc distance $\alpha$ between the devices 6 and 10 to grip the sheet leading and trailing edge has now been increased by the dimension of the size difference to the original arc distance $\alpha$ plus the dimension of the paper size difference.

While a preferred embodiment of a switchable sheet fed rotary printing press in accordance with the present invention has been fully and completely set forth hereinabove it will be apparent to one of skill in the art that various changes in, for example, the particular structure of the sheet grippers, the type of disengagable clutch, the vacuum supply means and the like may be made without departing from the true spirit and scope of the invention which is accordingly to be limited only by the following claims.

What is claimed is:

1. A sheet fed rotary printing press switchable between recto printing and recto and verso printing, said printing press having a sheet transfer drum which is disposed between first and second printers and having a drum body that is supported in hollow journals and having sheet grippers to grip the front edge of the sheets, said sheet transfer drum also having gripping means for gripping the rear edges of sheets, said gripping means being carried on a shaft supported in said hollow journals, said sheet transfer drum having identical gear wheels positioned generally parallel to each other, one of said gear wheels being carried on one of said hollow journals and the other of said gear wheels being carried on an end of said shaft; one of said gear wheels engaging a gear wheel of a transfer cylinder and the other of said gear wheels engaging a gear wheel of a reversing drum which is placed downstream in the direction of sheet transport and which has a gripper system for selectively gripping the front and rear edges of the sheets, said sheet transfer drum having a disengagable clutch which connects said two gear wheels in various angled positions for gripping the front and rear edges of sheets on the transfer cylinder, characterized in that in the recto printing position an arc distance between said sheet grippers and said sheet gripping means for gripping the front and rear edges of the sheets on said sheet transfer drum corresponds to an arc distance on the reversing drum which is the distance between grippers of said gripper system on the reversing drum for gripping the front and rear edges of the sheets and of a distance resulting from the displacement of the rear edge of the sheet during reversing plus the required paper edge for gripping the respective sheet at its front or rear edge, and in that the recto printing position can be set by means of cooperating stops on said sheet grippers and gripping means for gripping the front and rear edges of the sheets on said sheet transfer drum or on their cooperating gear wheels which can be coupled with each other.

* * * * *